US005551212A

United States Patent [19]

Odenthal

[11] Patent Number: 5,551,212

[45] Date of Patent: Sep. 3, 1996

[54] METHOD OF PACKAGING ARTICLES

[75] Inventor: Heinz F. Odenthal, Zülpich, Germany

[73] Assignee: Ostma Maschinenbau GmbH, Zulpich, Germany

[21] Appl. No.: 25,828

[22] Filed: Mar. 3, 1993

Related U.S. Application Data

[63] Continuation of Ser. No. 747,196, Aug. 16, 1991, abandoned.

[30] Foreign Application Priority Data

Sep. 1, 1990 [DE] Germany ..... 40 27 762.3

[51] Int. Cl.[6] ..... B65B 13/02; B65B 61/02

[52] U.S. Cl. ..... 53/397; 53/399; 53/411

[58] Field of Search ..... 53/139.7, 397, 53/399, 410, 411, 419, 461, 462, 465, 449, 580; 206/442, 453, 586, 597

[56] References Cited

U.S. PATENT DOCUMENTS

| | | | |
|---|---|---|---|
| 2,043,419 | 6/1936 | Robinson | 53/461 X |
| 3,187,480 | 6/1965 | Feeney et al. | 53/411 |
| 4,534,151 | 8/1985 | Schneck et al. | 53/465 X |
| 4,546,875 | 10/1985 | Zweber | 53/465 X |
| 4,631,900 | 12/1986 | Mattei et al. | 53/462 X |
| 4,828,110 | 5/1989 | Lems . | |
| 4,905,451 | 3/1990 | Jaconelli et al. | 53/410 |

FOREIGN PATENT DOCUMENTS

| | | |
|---|---|---|
| 0061805 | 3/1982 | European Pat. Off. . |
| 0225665 | 11/1986 | European Pat. Off. . |
| 0313721A2 | 3/1988 | European Pat. Off. . |
| 0313721A3 | 3/1988 | European Pat. Off. . |
| 8002686 | 7/1980 | Germany . |
| 3138439 | 4/1983 | Germany . |
| 3606826 | 9/1987 | Germany . |

*Primary Examiner*—Linda Johnson
*Attorney, Agent, or Firm*—Herbert Dubno; Andrew Wilford

[57] ABSTRACT

A package is formed by holding a nonextensible strip taut and wrapping it around the upper and/or lower periphery of the bundle and joining the ends of the strip segments e.g. by adhesive bonding. A projecting margin of the strip is folded to overlie the bundle or underlie the bundle so that an L-configuration is imparted to the frame formed around the bundle after the strip is applied thereto.

8 Claims, 2 Drawing Sheets

METHOD OF PACKAGING ARTICLES

CROSS REFERENCE TO RELATED APPLICATIONS

This application is a file-wrapper-continuation of copending patent application Ser. No. 07/747,196 filed 16 Aug., 1991 (now abandoned) with a claim to the priority of German patent application P 4,027,762 filed 1 Sep., 1990.

SPECIFICATION

1.Field of the Invention

My present invention relates to a method of packaging articles which can be assembled in a bundle or stack and which can be encircled by a retainer to form a package. More particularly, the invention relates to the formation of a package from a bundle of such articles in which the packaging material forms a frame having at least one open frame field.

2. Background of the Invention

German Utility Model 80 02 686 describes a process for the packaging of articles wherein L-shaped bars are applied to the edges of a stack. The L-shaped bars are preferably deep drawn plastic sections. Because of unavoidable tolerances between the material to be packaged and the encircling frame, retaining bands are required which must pass over the packaged material and across the open frame field. The formation of the package is expensive at least in part because format specific and product-specific L-shaped sections must be used and changeover for the packaging of stacks of different size or articles of different size is not simple. The same drawbacks apply also in the system described in EP-A- 0 313 721 in which a frame for supporting the articles is assembled from a multiplicity of prefabricated packaging bars.

The process described in German Patent Document DE-OS 36 06 826 applies a strongly stretched elongatable foil to the material to be packaged with a projecting margin such that the tension applied to the foil causes the margin to overlap the articles to be packaged. This type of packaging does not provide a shape-stable support frame structure. The cost of material for the packaging is high and, upon opening of the package, significant waste is generated, creating waste disposal problems.

German Patent Document DE-OS 31 38 439 describes a process for producing shaft-like packages with stiff bottom and top members and sidewalls. The packaging material is wrapped around the products to be packaged which are stacked on the bottom member and covered by the top member. This packaging material is wound around the assembly as a lateral strip and has margins projecting above the top part and below the bottom part and which can be adhesively bonded to them.

A frame structure with an open field is not formed by this method.

3. Objects of the Invention

It is, therefore, an important object of the present invention to provide a packaging method which provides a support frame for the packaged articles and thus has an open construction, but which nevertheless affords shape stability to the frame and allows the packaging method to be applicable to a wide variety of product sizes and shapes and packaging formats.

Another object of the invention is to provide an improved packaging method which obviates the drawbacks of earlier systems as described.

It is another object of my invention to provide a packaging method in which a minimum amount of material can be used for the packaging process and thus need be discarded as disposable waste, while nevertheless providing secure bundling of the articles and ready accommodation of the process to bundles of different sizes and shapes.

SUMMARY OF THE INVENTION

These objects and others which will become apparent hereinafter are attained, in accordance with the invention in that a strip of flat packaging material is drawn from a supply roll and applied tautly around the bundle of articles to be packaged so that a margin, rim or edge projects beyond the bundle and only after the strip has encircled the bundle, is this margin folded against the bundle. Overlapping ends of the strip or overlapping ends of segments of the strip can be bonded together.

The packaging material which is used is preferably cardboard, although other nonstretchable or nonelongatable materials can be used as well.

Since the material strip encircling the bundle can be cut to a length slightly greater than the perimeter of the bundle by a fixed cutting device positioned along the path of the bundle, the apparatus required for effecting the packaging operation is simple.

The ends of the encircling strip can, preferably after further tightening by pulling it taut, be cemented or adhesively bonded together when the encircling strip is composed of or coated with a thermoplastic material. The bonding can be effected by thermal welding, ultrasonic welding or the like.

It has been found to be advantageous, prior to application of the strip to the bundle, to score the strip to provide a preferential fold edge. In addition the strip can be embossed or printed with any appropriate advertising message or identification of the package and, of course, the margin can be cut at locations corresponding to the corners of the bundle to allow adjacent sections of the margin to overlap and form a neat corner.

More specifically, the packaging method of the invention can comprise the steps of:

(a) assembling a plurality of articles into a bundle wherein the articles are in contact with one another and upper and lower edges of the bundle define peripheries thereof;

(b) drawing a planar strip of a packaging material of a length greater than that of one of the peripheries from a supply roll of the packaging material;

(c) wrapping the planar strip around the one of the peripheries while drawing the strip taut so that a margin of the strip projects beyond the respective edge of the one of the peripheries and ends of the strip overlap upon complete encircling of the bundle by the strip;

(d) folding the margin inwardly to overlap the articles of the bundle and impart an angular cross section to the strip; and (e) connecting the ends together where the ends overlap.

According to the invention, a packaging strip encircles the bundle at least along its lower periphery with a downwardly projecting margin which is folded to underlie the bundle and the ends of this strip are cemented together where they overlap to form a planar frame capable of supporting the articles from below and securing them against shifting.

This type of packaging is similar to a so-called bottom tray.

According to another aspect of the invention, the packaging can form a space frame. In that case, I may provide a bottom frame in the manner described and a top frame in a similar manner. Bracing elements can connect the bottom frame and the upper closure frame. The bracing elements or struts can also be strips of cardboard fastened at their ends to the periphery encircling strips already described. Of course the struts or bracing elements can be composed of strip material different from that of the periphery encircling strips, for example thermoplastic bands. Other techniques in adhesive bonding can be used as well in the practice of this invention and I may mention, for example, stapling, welding of thermoplastic materials or the like. The bracing elements can be applied to corners of the package or along the sidewalls thereof. The advantage of the present invention is that product-specific and format-specific lengths of packaging material need not be prepared in advance. The ability to use a packaging material drawn from a supply roll permits a high degree of standardization for the packaging of bundles of different sizes. The packaging method is easily automatable and the package which results satisfies all practical requirements. In particular, the packaging of the invention protects the packaged material during handling and transport. The consumption of packaging material is small by comparison with the package volume so that the waste generated in commercial use of the invention and which requires disposal is small.

An important advantage of the invention is that packages of various shapes can be fabricated and the packaging accommodated to bundles of various shapes with ease. The method of the invention is not limited to the packaging of materials with precisely straight edges, for example, but can be used for packaging cylindrical products such as bottles and cans or the like as well as packagable products with flexible ill defined edges. For example, bundles of foil packages of paper goods such as napkins, diapers and the like.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figures 1, 4, 5:
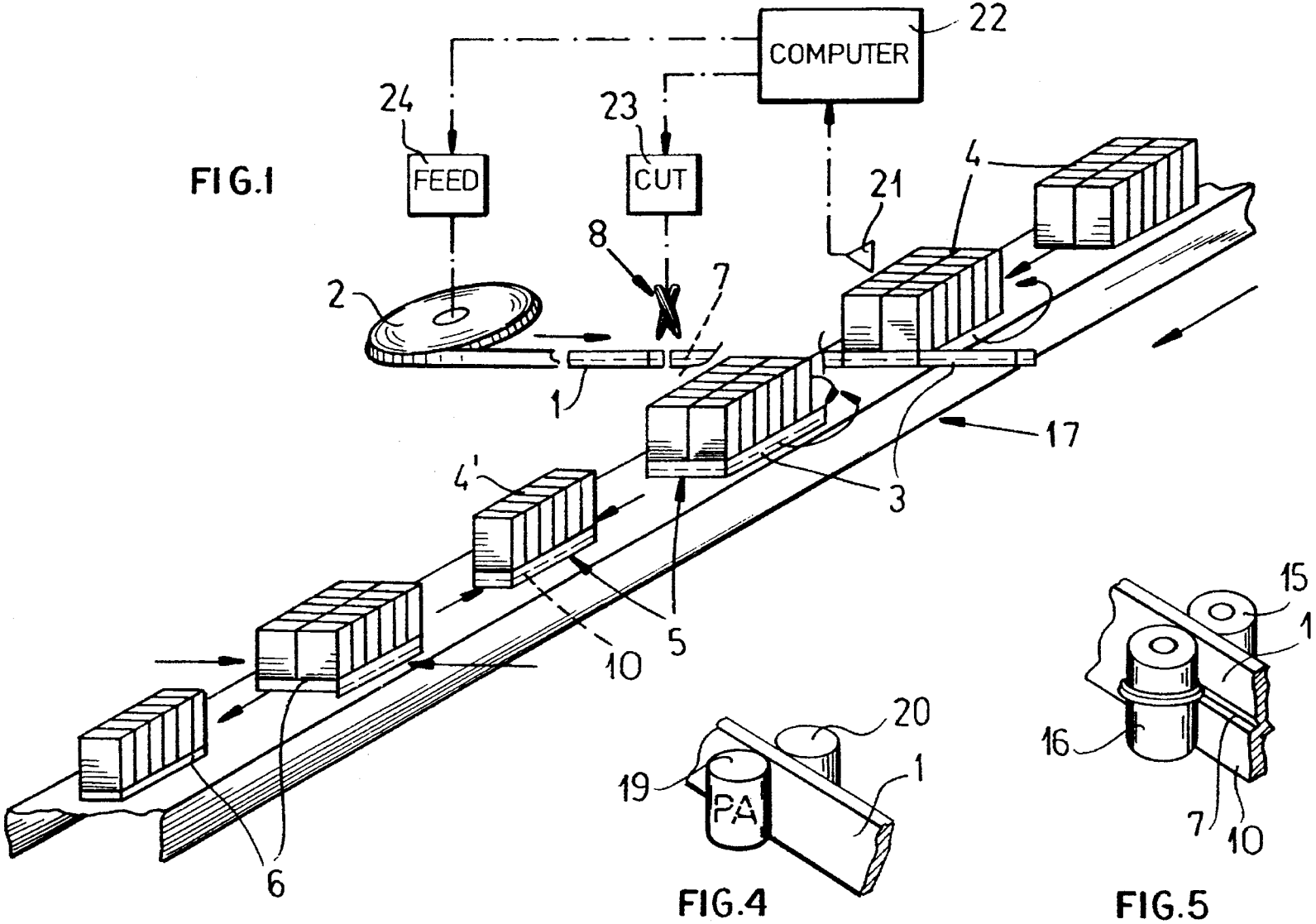
FIG. 1 is a perspective view illustrating the process of the invention.
FIG. 4 is a detail view illustrating imprinting or embossing of the packaging strip before it is applied to the bundle.
FIG. 5 is a perspective view diagrammatically illustrating the scoring of the strip.

The system shown in FIG. 1 is intended for the packaging of articles here shown to be rectangular parallelepipeds, e.g. boxes of goods utilizing a bottom-tray-type of packaging band. The package may be used for shipment, storage or point of sale display, e.g. in self-service establishments. The complete package comprises a frame structure formed by angle-section packaging elements and having at least one open frame field and in the case of the embodiment shown in FIG. 1, this frame is applied to the bottom of the package.

As can be seen from FIG. 1, a strip 1 of planar packaging material which is not elongatable, preferably cardboard, is drawn from a supply roll 2 and applied tautly against the bundle 4 of articles to be packaged, e.g. along the lower periphery of this bundle so that a margin 10 can project below the edge of this bundle.

Figure 2:
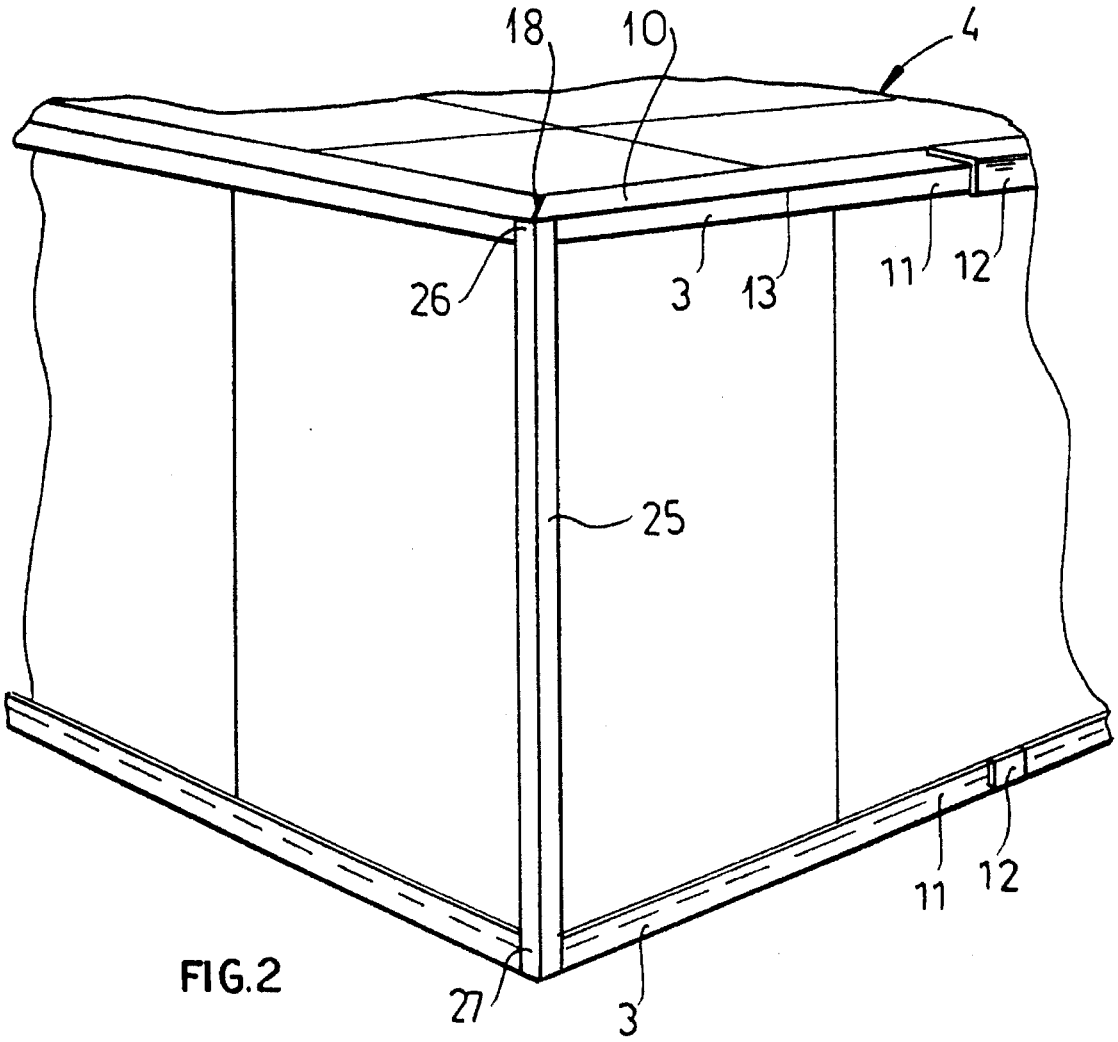
FIGS. 2 and 3 are perspective views showing aspects of the method.

In a successive stage, overlapping ends better seen at 11 and 12 for the encircling strip 3 in FIG. 2, will be adhesively bonded together or welded together if the strip 3 is coated with a thermoplastic material. The margin 10 which projects downwardly below the edge of the bundle is folded downward against to the bundle. As can be seen from FIG. 1 as well and as is represented by a broken line at 7, the strip 1 before it is applied to the bundle can be scored to form the fold edge. Such a fold edge is clearly visible at 13 for the margin 10 of the upper band 3 not used in the formation of the packages in FIG. 1. Scoring may be effected at 7 by passing the strip 1 between a pair of scoring rollers 15 and 16 as represented in FIG. 5.

At a cutting station 8 which is fixed between the supply roll 2 and the station 17 at which the bundle 4 is represented to provide the encircling band 3, an appropriate length of the strip 1 is cut off from the supply from roll 2. At the cutting station 8, moreover, individual cuts can be made in the margin 10, as, for example, the cut visible at 18 in FIG. 2, so that the margin 10 can be folded inwardly neatly with the sections of the margin at the corner of the package able to be folded over or under one another and bonded together by welding or adhesion bonding.

As will be apparent from FIG. 4, the strip 1 before it is applied to the bundle 4 can also be embossed or printed between embossing or printing rollers 19 and 20.

As can be seen from FIG. 1 as well, bundles 4 and 4' of different format or size can be packaged.

For example, a sensor 21 can detect the size of the bundle 4 to be packaged and can feed the appropriate information to a computer 22 which controls the cutting at 8 via the cutter control 23 and the feed of the strip 1 at a feeder control 24. The computer can also control cutting of the margin 10 at the appropriate locations to correspond to the corners of the package.

In FIG. 2 I have shown that the encircling bands 3 can be provided along both the bottom edge and the top edge of a bundle 4 and then these bands can be interconnected by struts or bracing elements 25, for example, of cardboard or thermoplastic, welded at their ends 26 and 27 to the encircling strips 3 or adhesively bonded thereto. The struts 25 are here shown to be bent into an L-shape to lie along corners of the bundle.

Figure 3:
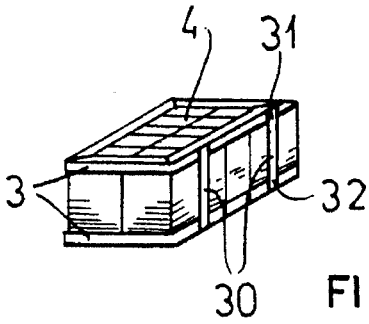

In FIG. 3 I have shown an embodiment in which the bundle 4 is wrapped with the upper and lower encircling strips 3 in the manner described, but the bracing strips 30 are flat strips adhesively bonded at their ends 31 and 32 to the upper and lower strips.

I claim:

1. A method of packaging a plurality of articles, the method comprising the steps of:

(a) assembling a plurality of the articles into a bundle with the articles in contact with one another and the bundle having upper and lower annular edges, a plurality of corners at each of the edges, respective top and bottom surfaces bounded by the edges, a predetermined height between its top and bottom surfaces, and side faces;

(b) drawing a planar strip of a substantially non-stretchable cardboard packaging material of a width less than the height of the bundle and of a length greater than that of one of the edges from a supply roll of the packaging material and severing the strip from the supply roll so that the strip has two ends;

(b') scoring the strip to define a fold line extending a full length of the strip;

(b") cutting a margin of the strip at respective locations spaced corresponding to the corners of the one edge;

(c) wrapping the scored and cut planar strip around the one edge on the side faces in direct contact with the articles with the fold line at the one edge and the margin cuts at the corners while drawing the strip taut so that the margin of the strip projects beyond the one edge, the side faces of the bundle are left mainly exposed by the strip, and the ends of the strip overlap upon complete encircling of the bundle by the strip;

(d) folding the margin inward long the fold line to overlap the articles of the bundle on the respective surface, to overlap the margin with itself at the corners, and to impart an L-section to the strip; and (e) connecting the ends together where they overlap and connecting the margin together where it overlaps at the corners.

2. The method defined in claim 1 wherein the articles are rectangular parallelepipeds.

3. The method defined in claim 2 wherein another such strip is applied by steps (b) to (e) to the other of the edges of the bundle so that margins of both of the strips are folded to overlie and underlie the bundle on the respective top and bottom surfaces thereof, whereby respective open frame fields are formed on the top and bottom surfaces of the bundle as well as on the side faces between the upper and lower edges.

4. The method defined in claim 1, further comprising the step of embossing the strip prior to applying the strip to the bundle.

5. The method defined in claim 1, further comprising the step of printing the strip prior to applying the strip to the bundle.

6. The method defined in claim 3, further comprising the step of applying to each of the side faces of the bundle a respective connector connecting the strips encircling the bundle along the upper and lower edges.

7. The method defined in claim 6 wherein the bundle has vertical corners and the connectors are folded bands of packaging material lying along the corners of the bundle and adhesively bonded to the strips at the corners of the bundle.

8. The method defined in claim 6 wherein the bundle has vertical corners and the connectors are bands of packaging material lying on the side faces of the bundle and adhesively bonded to the strips between the corners of the bundle.

* * * * *